United States Patent [19]

von Meyer

[11] Patent Number: 4,817,228

[45] Date of Patent: Apr. 4, 1989

[54] PNEUMATIC SPONGE MOP

[76] Inventor: Robert F. von Meyer, 300 W. 109th St., New York, N.Y. 10025

[21] Appl. No.: 153,216

[22] Filed: Feb. 5, 1988

[51] Int. Cl.[4] ..... A47L 13/12

[52] U.S. Cl. ..... 15/119 A; 15/244.1

[58] Field of Search ..... 15/119 A, 244.1

[56] References Cited

U.S. PATENT DOCUMENTS 2,983,944 5/1961 Uselis ..... 15/119 A X 4,322,865 4/1982 von Meyer ..... 15/119 A

*Primary Examiner*—Chris K. Moore

[57] ABSTRACT

An improved automatic sponge mop with a hollow handle containing a piston which when pulled backwards creates a vacuum in the wringer mechanism. The wringer is an airtight box with a movable bottom and flexible walls capable of collapsing in upon itself in response to the vacuum and in so doing compressing an affixed sponge. After the sponge is wrung out the user pushes the piston downwards and the process is reversed, opening the sponge into its original cleaning position. The sponge is held in place by dovetail fasteners which allow easy removal by pulling sideways on the sponge until it slides off the wringer. Similarly, replacement is accomplished by engaging the tongue and groove connections and pushing the sponge back on. Sliding and removal are inhibited because the sponge is always under tension from the springlike walls of the wringer.

6 Claims, 2 Drawing Sheets

PNEUMATIC SPONGE MOP

FIELD OF INVENTION

This invention relates to floor cleaning devices for the home and particularly squeeze mops with replaceable mop heads.

CROSS-REFERENCE TO RELATED PATENTS

This design is actually an improved version of my 1982 U.S. Pat. No. 4,322,865. It is identical to it except for the wringer mechanism wherein I have eliminated the rubber diaphragm and shank and substituted a collapsible box. This simplifies the design, creates a bigger air chamber, and therefore imparts a greater wringing force upon the sponge.

DISCUSSION OF PRIOR ART

Sponge mops have always fallen into two catagories: those which are wrung out squeezing the sponge between two hard surfaces directly by hand, and more recently those which accomplish the same thing by "automatic" or remote control means. Although considered "labor saving devices" the latter are still hard work for the user after numerous wringings because of too many parts rendering them inefficient machines. There are, for example, at least four moving parts involved in actuating the mops in U.S. Pat. Nos. 2,926,373 and 1,912,543. In addition to being a headache to manufacturers these complex machines lack any mechanical advantage whatever as with U.S. Pat. Nos. 2,733,467 and 3,233,269; i.e., one would need a ton grip to use them.

Also a nuisance is replacing a worn mop head or sponge. This usually requires unscrewing things or forcing pins through holes with one's fingers or sometimes tools.

OBJECTS

While clearly belonging to the automatic sponge mop family my design attempts to overcome some of the afore mentioned disadvantages. By using an airtight tube in place of a conventional handle air pressure itself can be utilized to transfer a movement from one end of the device to the other end. As with a simple bicycle pump all that is required is a freely moving piston and you eliminate all rods, wires, levers, etc. Furthermore, the bicycle pump approach eliminates the need for the user to apply a great force to wring the sponge by distributing the short, abrupt movement at the wringer end over the much longer distance of the handle. This phenomenum is the principle used in the hydraulic press where a small piston traveling over a great distance can exert a tremendous force in a large piston.

Accordingly some of the objects of my mop are: the reduction of moving parts making it a more efficient machine, less effort in actuating the mop, and greater facility in mop head replacement. Further objects and advantages of my invention will become apparent from a consideration of the drawings and description thereof.

Figure 1:
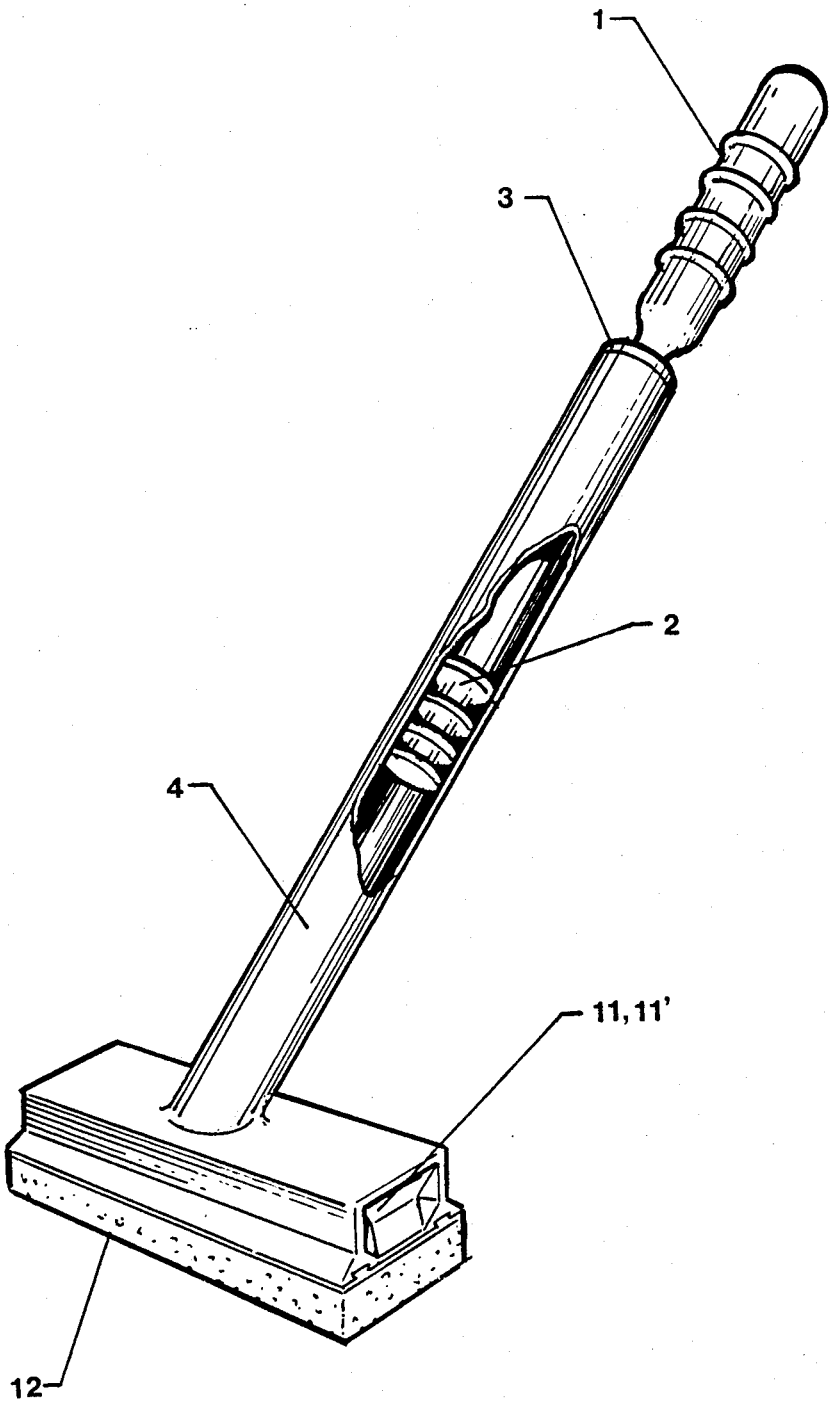
FIG. 1 is a perspective view of the entire mop with a partial cutaway of the handle exposing the piston.
Figure 4:
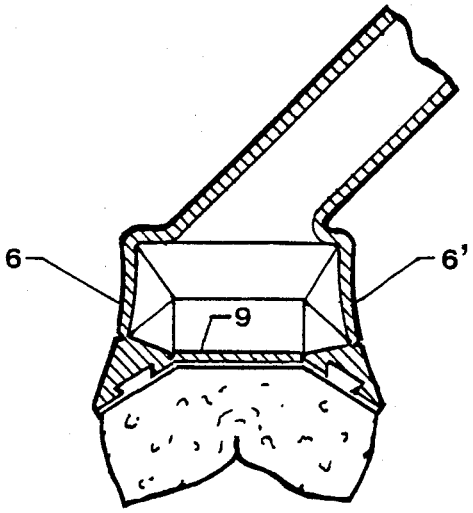
Figure 3:
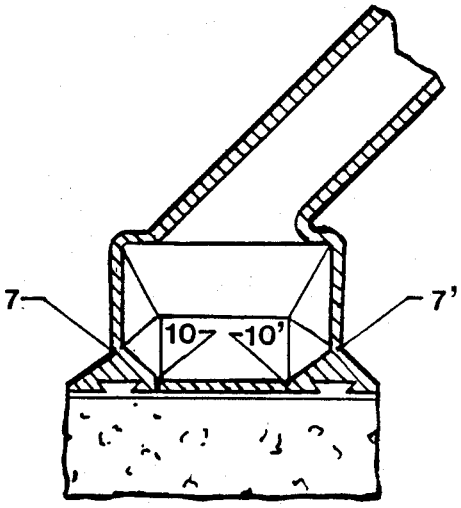
Figure 5:
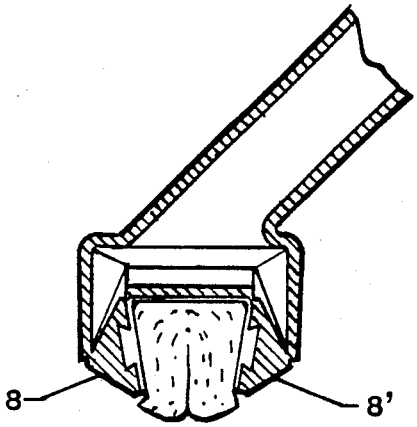
Figure 2:
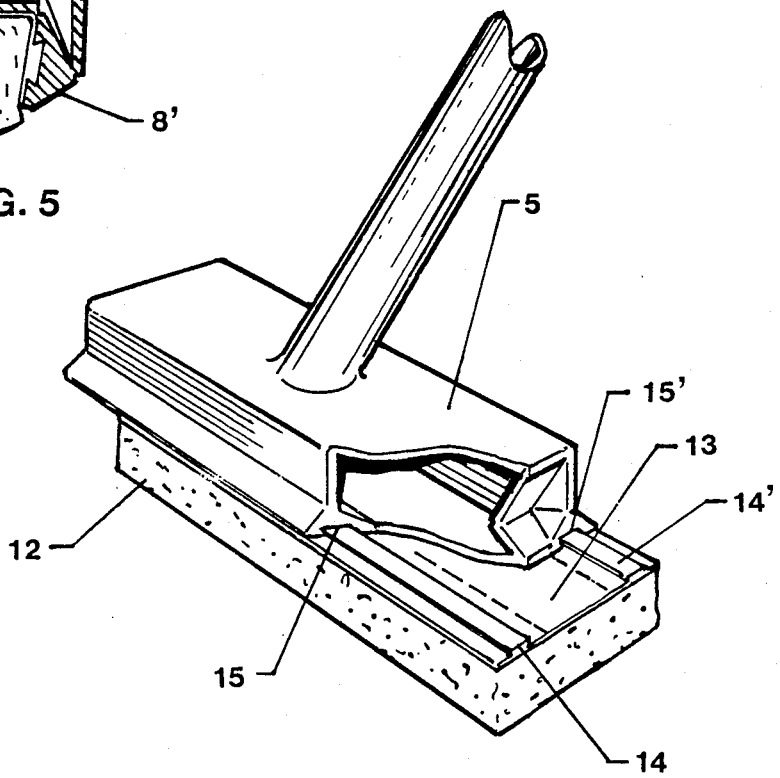
FIG. 2 is a cutaway perspective view of the wringer. Also shown is the sponge and how it fastens to the wringer.

FIGS. 3, 4, and 5 are cross sectional views of the mop being compressed and the action of the wringer.

DESCRIPTION

Not unlike most the improved mop resembles an inverted 'T' with the handle at the stem and the wringer at the crossbar. The elongated handle (4) is hollow and encloses a piston (2) which is held on center and captivated by a retaining ring (3). Affixed to the handle is the wringer mechanism. This is a hermetically sealed box consisting of a rigid roof (5) spanning two flexible walls (6) and (6'), connected by two hinges (7) and (7') to presser plates (8) and (8') which are connected to the spine (9) by hinges (10) and (10'). On the ends the wringer is sealed by articulated end caps (11) and (11') which permit vertical movement of the spine. The mop head (12) is bonded to a backing (13) from which runners (14) and (14') mate with corresponding slots (15) and (15') of the presser plates.

OPERATION

For mopping action the presser plates (8) and (8') are in an extended position as shown in FIG. 3 allowing maximum contact with the floor by the attached mop head (12). When the user wishes to wring the mop head the handle (4) is held steady and the piston (2) drawn rewardly by its grip (1). This creates a relative vacuum in the handle and also in the attached wringer. This vacuum causes the atmospheric pressure outside the mop to bear upon the spine (9) causing it to collapse upwards. The spine in turn pulls at the presser plates through hinges (10) and (10') causing them to rotate inwards about hinges (7) and (7') until they reach the vertical position shown in FIG. 5. In order to achieve this the walls (6) and (6') must flex outward as shown in FIG. 4. This flexibility permits rotation of the presser plates which can only be accomplished if their other hinged connections (7) and (7') are allowed to move laterally while their inner hinged connections (10) and (10') move vertically.

Concomitantly the sponge (12), being firmly affixed to the presser plates, is being bent and folded along its long axis as shown in FIG. 4 until it reaches the position in FIG. 5 wherein it is completely compressed and the water has been squeezed out. This compression is further facilitated by the springlike action of the walls which bear back inward to resume their normal position. To get the mop back into its working position again the user need only push the piston downwards and the entire process is reversed; the plenum of air forces the spin downwards, the presser plates to rotate back open, and the sponge to unfold.

In order to replace a worn sponge the user must disengage the dovetail fasteners which hold the sponge to the presser plates. This is done by simply grasping the sponge and pulling it laterally off the slotted presser plates. A new sponge is then inserted by nesting the runners (14) and (14') into keyways (15) and (15') and pushing the sponge until it is again centered on the wringer. Accidental removal is inhibited because in its mopping position FIG. 3 the sponge and its backing are always slightly under tension. That is, the sponge is being pulled or stretched from front to back by the wringer whose walls (6) and (6') are always slightly flexed in this position. This causes a friction fit or tightness in the fasteners impeding lateral movement.

While the above description contains many specificities, these should not be construed as limitations on the scope of the invention, but rather as an exemplification of one preferred embodiment thereof. Many other variations are possible, for example: the elongated shape of the wringer could be changed to a square or radial design and the results would be the same; a liquid could be confined to the hollows of the mop, as with the hydraulic press mentioned above, and the results would be the same. Accordingly, the scope of the invention should be determined not by the embodiment illustrated, but by the appended claims and their legal equivalents.

What I claim is:

1. A self-wringing sponge mop, comprising: an airtight tubular handle;

means for intermittently creating a partial vacuum within said handle;

an airtight box at one end of, and in sealed communication with said handle;

one side of said box being formed by a flexible member having two surfaces;

one of said surfaces facing the interior of said box, and the other of said surfaces facing outwardly of said box and being provided with means for mounting a sponge mop head;

and a sponge mop head attached to said mounting means, whereby, when said partial vacuum is created, said flexible member is pulled into the interior of said box, causing said member to at least partially surround said attached sponge, thus compressing said sponge to wring it.

2. A self-wringing sponge mop as set forth in claim 1, wherein said box consists of a rigid top, flexible side walls depending from said rigid top, and said flexible member being attached to the ends of said side walls.

3. A self-wringing sponge mop as set forth in claim 2, wherein said flexible member comprises: a pair of rigid presser plates respectively hingedly connected to an end of a respective one of an opposed pair of said side walls; and a central spine section hingedly connected on opposing sides to each of said presser plates; whereby upon application of said partial vacuum, said side walls flex outwardly, said presser plates rotate inwardly about said hinged connection to said side walls, and said spine moves inwardly to compress said sponge mop head between said presser plates.

4. A self-wringing sponge mop as set forth in claim 3, wherein said rigid top, flexible side walls, presser plates, spine and sponge mop head are all elongated in a direction parallel to said hinged connections.

5. A self-wringing sponge mop as set forth in claim 1, wherein said partial vacuum-creating means comprises a manually-reciprocable piston received within said tubular handle.

6. A self-wringing sponge mop as set forth in claim 1, wherein said box, flexible member and mop sponge head are all elongated in a direction transverse to the length of said handle.

* * * * *